US011602825B2

(12) United States Patent
Roller

(10) Patent No.: US 11,602,825 B2
(45) Date of Patent: Mar. 14, 2023

(54) BOAT PROPELLER WRENCH WITH EMBEDDED METALLIC MOTOR NUT FASTENER

(71) Applicant: Michael L. Roller, Purdy, MO (US)

(72) Inventor: Michael L. Roller, Purdy, MO (US)

(73) Assignee: Mike L. Roller, Purdy, MO (US)

( * ) Notice: Subject to any disclaimer, the term of this patent is extended or adjusted under 35 U.S.C. 154(b) by 144 days.

(21) Appl. No.: 16/350,954

(22) Filed: Feb. 4, 2019

(65) Prior Publication Data

US 2019/0176296 A1 Jun. 13, 2019

Related U.S. Application Data

(63) Continuation-in-part of application No. 29/651,121, filed on Dec. 13, 2017, now abandoned.

(60) Provisional application No. 62/709,943, filed on Feb. 6, 2018.

(51) Int. Cl.

| | |
|---|---|
| ***B25B 13/06*** | (2006.01) |
| ***B25B 23/16*** | (2006.01) |
| ***B25B 23/00*** | (2006.01) |
| ***B25B 13/48*** | (2006.01) |
| ***B25G 1/10*** | (2006.01) |

(52) U.S. Cl.

CPC ..... *B25B 13/06* (2013.01); *B25B 13/48* (2013.01); *B25B 23/0035* (2013.01); *B25B 23/16* (2013.01); *B25G 1/105* (2013.01)

(58) Field of Classification Search

CPC ..... B25B 13/04; B25B 13/06; B25B 13/48; B25B 23/0035; B25B 23/16; B25G 1/105

USPC ..... 81/52, 124.3, 900

See application file for complete search history.

(56) References Cited

U.S. PATENT DOCUMENTS

| | | | | |
|---|---|---|---|---|
| 3,836,763 | A | 9/1974 | Hoffman et al. | |
| 3,908,489 | A | 9/1975 | Yamamoto et al. | |
| 4,145,938 | A | 3/1979 | Laird, Jr. | |
| 5,022,875 | A | 6/1991 | Karls | |
| 5,263,389 | A | 11/1993 | Frazzell et al. | |
| 5,489,151 | A | 2/1996 | Weber | |
| 5,638,727 | A | 6/1997 | Gringer | |
| 6,418,820 | B1 * | 7/2002 | Lamond | B25G 1/105 81/177.1 |
| 7,841,261 | B2 * | 11/2010 | Milligan | B25B 13/06 81/121.1 |
| 9,567,049 | B2 | 2/2017 | Ulgen | |
| 9,611,020 | B2 | 4/2017 | Ulgen | |

OTHER PUBLICATIONS

Author: Wholesale Marine Title: Product Spotlight: Mercruiser Propeller Wrench Publication Date: Feb. 28, 2014 URL: https://www.youtube.com/watch?v=qlUlrdcRHVg (Year: 2014).*

(Continued)

*Primary Examiner* — Lee D Wilson
*Assistant Examiner* — Alberto Saenz
(74) *Attorney, Agent, or Firm* — Armstrong Teasdale LLP

(57) ABSTRACT

A boat motor propeller wrench with metallic motor nut fastener is described. The wrench includes a polymer handle including a first end and a second end opposite the first end, the second end including a tethering aperture. The wrench also includes a socket formed as one piece with the handle and extending from the first end of the handle substantially perpendicular thereto, the socket defining an aperture. The wrench further includes a metallic insert disposed within the aperture of the socket.

12 Claims, 3 Drawing Sheets

(56) References Cited

OTHER PUBLICATIONS

Title: RITE-HITE Polymer Light-Weight Propeller Wrench URL: https://www.amazon.com/dp/B0030HMYFE/ref=sspa_dk_detail_2?psc=1&pd_rd_i=B0030HMYFE&pd_rd_w=eRTzz&content-id=amzn1.sym.dd2c6db7-6626-466d-bf04-9570e69a7df0&pf_rd_p=dd2c6db7-6626-466d-bf04-9570e69a7dfO&pf_rd_r=XW2RAND8 Date: Aug. 6, 2012 (Year: 2012).*

Title: Attwood 11370-7 Universal Prop Wrench Kit with Multiple Sockets URL: https://www.amazon.com/attwood-Universal-Multiple-Sockets-11370-7/dp/B019EKVKSC/ref=sr_1_10?keywords=propeller+wrench&qid=1674744036&sr=8-10 Date: Oct. 22, 2015 (Year: 2015).*

* cited by examiner

BOAT PROPELLER WRENCH WITH EMBEDDED METALLIC MOTOR NUT FASTENER

CROSS REFERENCE TO RELATED APPLICATION

This application is a non-provisional application of the provisional application having Ser. No. 62/709,943 filed on Feb. 6, 2018, which is a continuation-in-part of the design patent application filed in the United States Patent Office on Dec. 13, 2017 under Ser. No. 29/651,121.

BACKGROUND OF THE INVENTION

This invention relates to a boat motor wrench, and more specifically to a marine wrench that can securely fasten to the propeller nut, that holds the propeller in place, and which is internally metallic reinforced so as to prevent the wrench from becoming stripped, due to excessive use or force, and one that will securely hold onto the propeller nut, during its application or removal from the boat motor during servicing. The propeller wrenches currently available in the art are simply an effort to utilize the standard wrench, which is difficult to insert into the cavity where the propeller nut locates, and does not attain an established grip upon the nut, during its loosening or fastening. Furthermore, other types of wrenches that are of the more socket type, and available upon the market, are made of polymer material, and can easily strip due to the polymer becoming misshapen, where it grasps the nut, primarily due to excessive force and pressure being applied and which the available wrench cannot be accommodative of said pressures being applied to it.

The current invention is designed to alleviate these types of problems.

Furthermore, the wrench of the current invention has means to provide for its tethering, a feature which is normally not provided with related types of wrenches, that are available for use with marine equipment, such as the boat motor, for use for removal or fastening and securement of the propeller nut, during servicing of the motor.

Various styles of prior art and propeller wrenches can be seen in the prior patents, and U.S. Pat. No. 5,263,389, to Frazzell, et al., shows a Torque Rated Floating Marine Propeller Wrench. In this particular embodiment, the body of the wrench includes a polymer formed socket portion, that is molded having an inner shaped profile, and this type of wrench, almost completely made of polymer, will eventually become misshapen, at its socket portion, due to excessive force being applied to the wrench, during its application and usage. In this prior art, in an effort to reduce that type of a problem, the wrench shows the application of a metal ring member to the outer profile of the socket portion, and while this may help in preventing a misshaping or stripping of the socket, during repeated usage, it still does not prevent a misshaping of the formed hexagonal socket portion, over time, due to repeat and excessive force applications. Furthermore, this propeller wrench, if dropped in the water, is lost, because it has no facility for application of a tether to it, to prevent submersion if released.

Other types of wrench devices, for use with a boat, or its motor and propeller, can be seen in the U.S. Pat. No. 9,611,020, to Ulgen, showing a Mechanically-Adjustable Pitch Propeller. Another U.S. Pat. No. 9,567,049, to the same inventor, shows a Self-Adjustable Pitch Propeller and a tool for use in conjunction therewith. U.S. Pat. No. 5,638,727, discloses a Plastic Screwdriver with Retaining Ring.

In addition to the foregoing, the use of a tool externally of a unit assembly for clamping purposes, can be seen in the prior U.S. Pat. No. 3,836,763, to Hoffman, et al., upon a Vehicle Lighting Unit Assembly. In addition, a Fastener Driver is shown in the U.S. Pat. No. 3,908,489, to Yamamoto, et al. A Strap Wrench, as known in the art, is shown in the U.S. Pat. No. 4,145,938, to Laird, Jr. Finally, a Marine Propeller Locking Tab Washer is shown in U.S. Pat. No. 5,022,875, to Karls. These are the prior art known to the applicant.

SUMMARY OF THE INVENTION

This invention contemplates improvements to the type of wrench that is used in the application or removal of the fastener or nut that secures the propeller to the shaft of a boat motor. Essentially, it is formed of a more hardened type of polymer, such as polypropylene, that can sustain and resist the heavy forces that are exerted upon its wrench handle, for accommodating leverage, for use for the removal of the nut, when the boat motor propeller needs servicing, or for the installation of a new propeller, after completion of such service. But, normally, as known in the art, polymer alone in forming the entire wrench, does not perform satisfactory, especially when excessive force is applied to it, when tightening or loosening the propeller nut, during its installation or removal. Thus, the current invention includes an insert, that is located within the molded handle, the insert generally having a hexagonal configuration, to accommodate the insertion of the nut therein, and the insert is formed of metal, usually stainless steel to avoid corrosion, and it is press fitted or molded into the molded hexagonally shaped aperture formed within the head of the wrench, to form a metal internally reinforced socket for the wrench for its usage for the purposes of this invention. Then, a handle integrally extends from the socket of the wrench, for some distance, perhaps in the length of a foot or more, in order to supply that leverage necessary to the wrench when force is applied to it, when processing the propeller nut, during service. The handle may have embedded therein a reinforcement, in the form of a metallic rod, whether it be round or rectangular in cross-section, that affords greater strength to the wrench, during its usage and application by the boat owner, or the servicing personnel.

Another feature of this invention is the inclusion of an aperture at the tail end of the handle or shank of the wrench, to which a tether may be secured, and further secure at its opposite end to the boat, or to the serviceman, particularly where the servicing of the motor is being done over water, such as at a dock, along a shoreline, or the like, as experienced by many boat owners, when damage is encountered by the propeller, during movement of the boat, and requires immediate mechanical servicing.

The essence of this current invention is the application of an insert, of stainless steel, having an internally formed hexagonal shaped socket, that is applied to the socket head of the molded wrench, and can be pressure fitted therein, or glued or molded in place, and which will be prevented from turning because the polymer socket aperture will also be molded into a hexagonal configuration, to accommodate the pressure fitting of the metal insert therein.

It is, therefore, the principal object of this invention to provide a socket wrench which is reinforced with a metallic socket, for use and application within the type of wrench applied for servicing a boat motor, and can be used for removal or installation of the propeller nut, during servicing.

A further object of this invention is to provide a reinforced socket, internally of the wrench, and which will be corrosion inhibiting because of its formation from stainless or other steel into a shaped insert for application within the socket head of the formed wrench.

Another object of this invention is to provide a polymer wrench, that has a metal socket insert that can be applied into the head of the wrench, and which engages the nut of a boat propeller to accommodate and resist the excessive forces that are applied when removal of the propeller nut, or its installation, after motor servicing.

Still another object of this invention is to provide a boat motor wrench that is reinforced integrally with a metal reinforcement rod along the length of its integral handle.

Another object of this invention is to provide a boat motor wrench that can be tethered to the boat or the person servicing the motor, to prevent its untimely deposit into the river or lake water, and its loss.

A further object of this invention is to provide a boat motor wrench which is generally formed substantially of a hardened polymer, in order to reduce its cost, to allow to be molded into the precise configuration necessary for application of a socket insert within its wrench head during manufacture and assembly.

These and other objects may become more apparent to those skilled in the art upon review of this summary of the invention as provided therein, and upon undertaking a study of the description of its preferred embodiment, in view of the drawings.

DESCRIPTION OF THE PREFERRED EMBODIMENT

Figure 1:
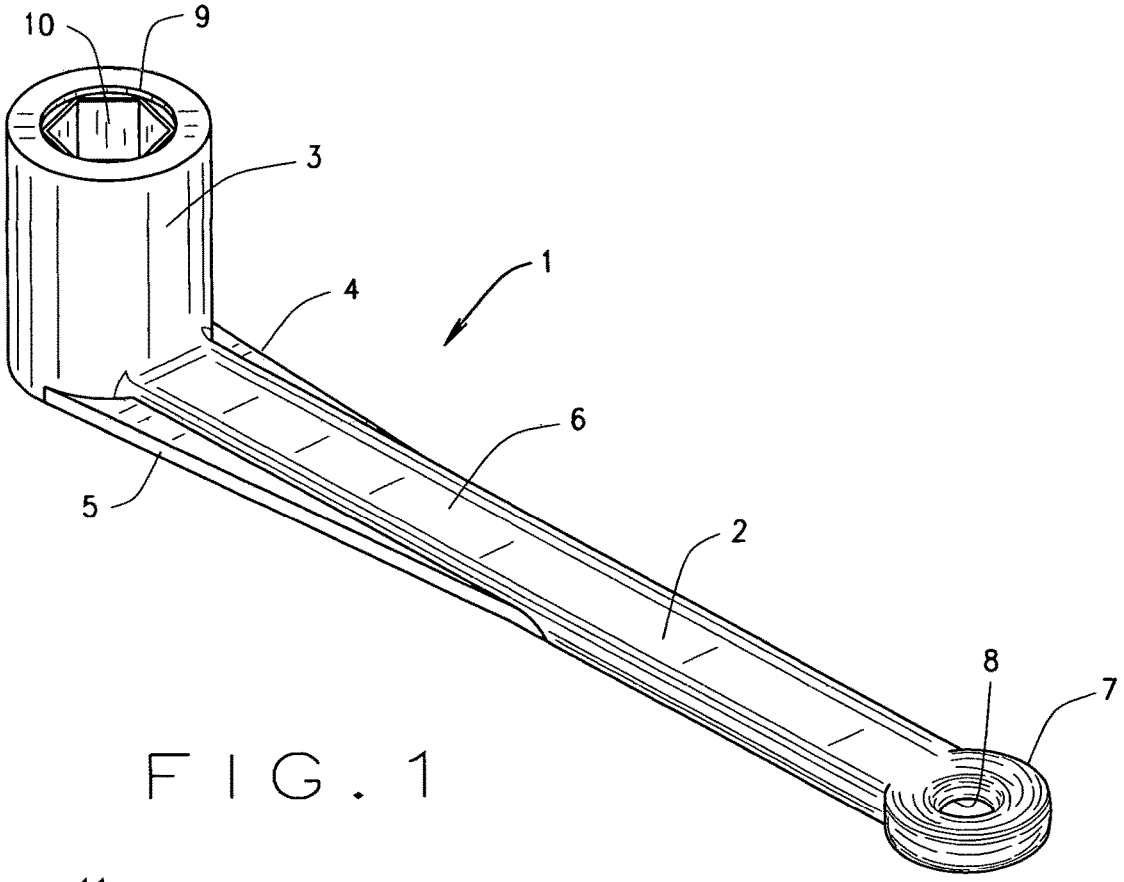
FIG. 1 is an isometric view of the boat propeller wrench with metallic motor nut fastener inserted within the wrench head.

In referring to the drawings, and in particular FIG. 1, the "Propeller Wrench with Metallic Motor Nut Fastener" 1 is readily disclosed. It has a handle portion 2, integrally made with the socket part 3 which generally is perpendicularly aligned with the handle, when formed. The handle has various reinforcing flanges, as at 4 and 5, to share its retention to the socket, particularly when substantial force is applied to the handle, to obtain leverage upon the socket as it tries to dislodge, or fix during installation, of the propeller nut, during its manipulation. While not shown, the handle may have a length of reinforcing rod or bar, generally internally as noted at 6, in order to give further strength to the wrench, for application when substantial force is applied to it, particularly when attempting to extract the propeller nut, as at N, from the motor, during servicing.

As can further be seen, the back end 7 has an aperture 8 provided therethrough, into which a tethering cord T, or other linkage, can be applied, so that the device can be secured, at its opposite end, to the user, such as around a belt, or the like, or any type of wristband, as known in the art. Many times, the propeller needs to be removed on the spot, such as when it encounters a rock and shatters a blade, and must be removed, and replaced with another propeller, sometimes even when the boat may be on the water, at a shore, or at the dock, when such a predicament necessitates propeller service.

Figure 8:
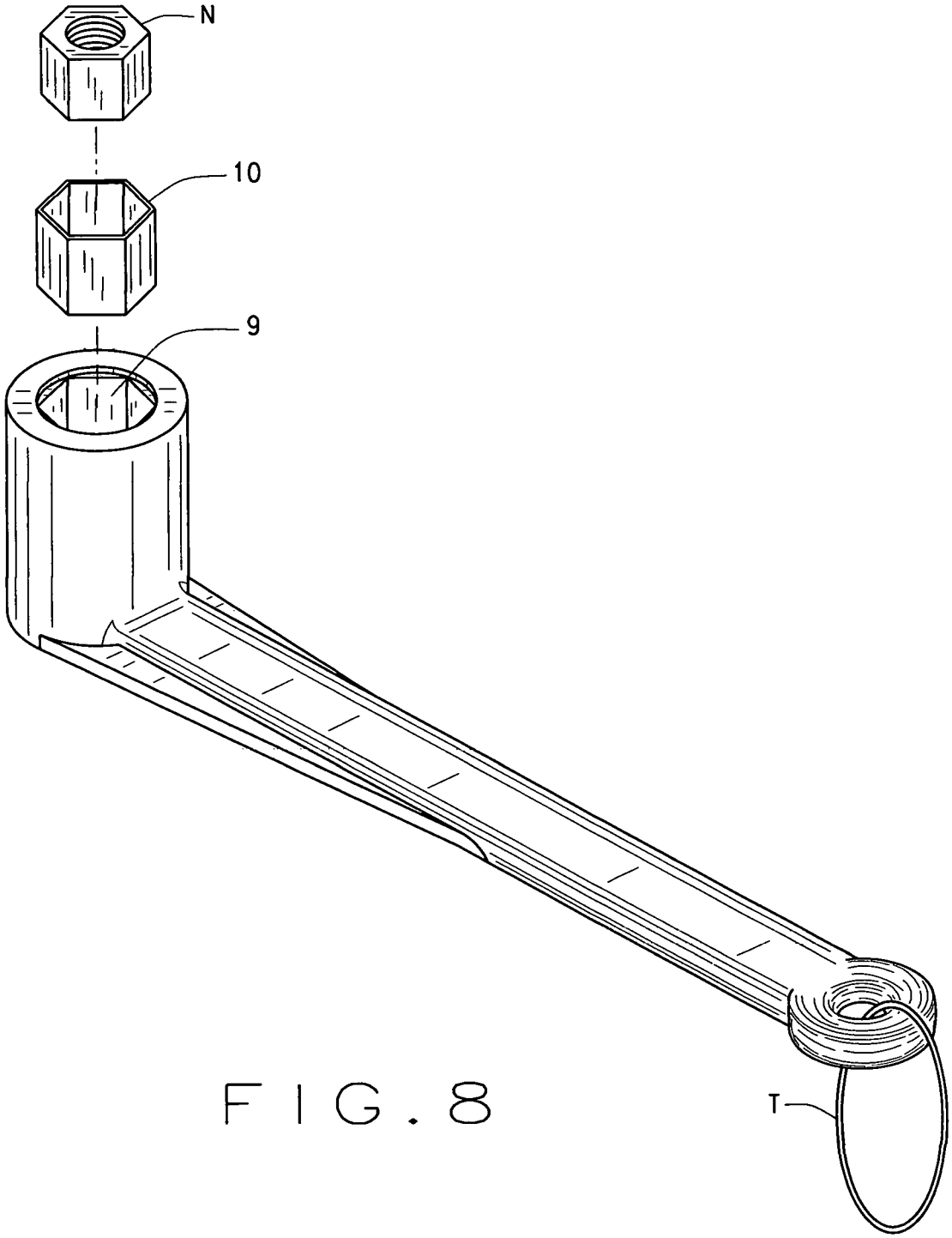
FIG. 8 is a view showing the wrench head and its integral handle, and the stainless steel insert in the process of being inserted into the molded socket of the wrench head during its assembly.

The opposite end of the wrench, or the socket feature 3, as previously defined, includes a central aperture, as at 9, provided extending therethrough, which at the upper segment, is formed to a depth of approximately an inch or two, and generally will be molded into a hexagonal configuration, in order to receive the hexagonal shaped insert, as shown at 10, as noted in FIG. 8. This insert 10 is formed of metal, while the remainder of the wrench body may be molded from a hard polymer, such as polypropylene, or a related hard type of polymer, that can be used for forming the configuration of the wrench body, as noted. Preferably, the hexagonal insert 10 will be formed of stainless steel, so as to resist corrosion, particularly after repeated usage when exposed to wet and water conditions, during its application and removing or setting a propeller onto its motor, during servicing. It can be pressure fitted, molded or adhesively applied to the wrench handle.

Figure 2:
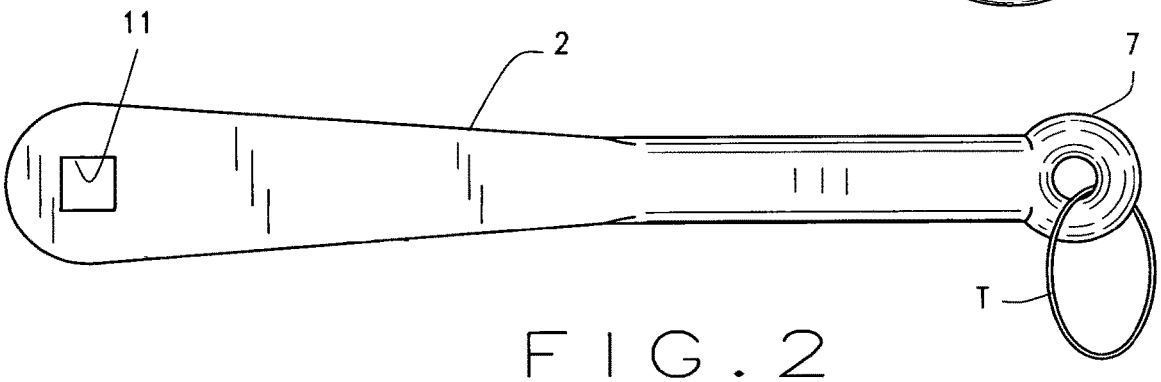
FIG. 2 is a bottom view of the wrench.

The bottom of the aperture 9, as can be seen in FIG. 2, is formed of a square configuration, as noted at 11, so that any water that gets into the aperture 9, of the socket, can quickly drain out, while the wrench is being used.

Figure 3:
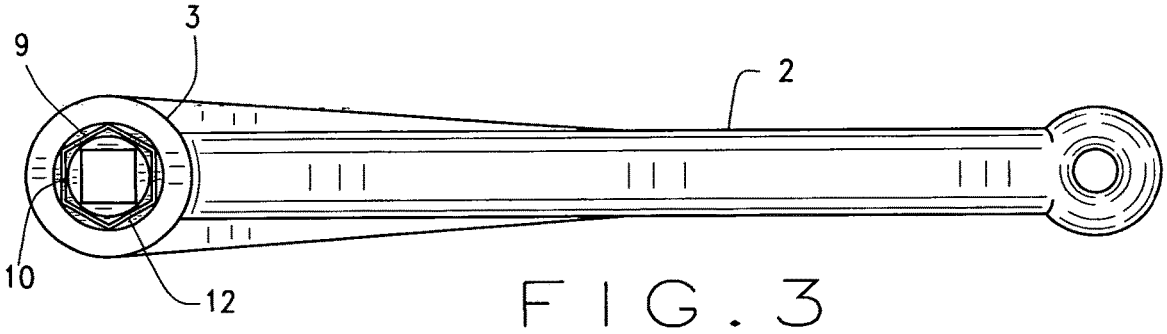
FIG. 3 is a top view of the wrench.

As can also be seen in FIG. 3, the socket 3, and its aperture 9 holding the insert 10 in place, may also have some quantity of adhesive, as at 12, to further aid in holding the insert 10 in place, so that it does not slip, or strip the interior opening 9 of the socket, when excessive force is applied to the wrench, during its usage.

Figure 4:
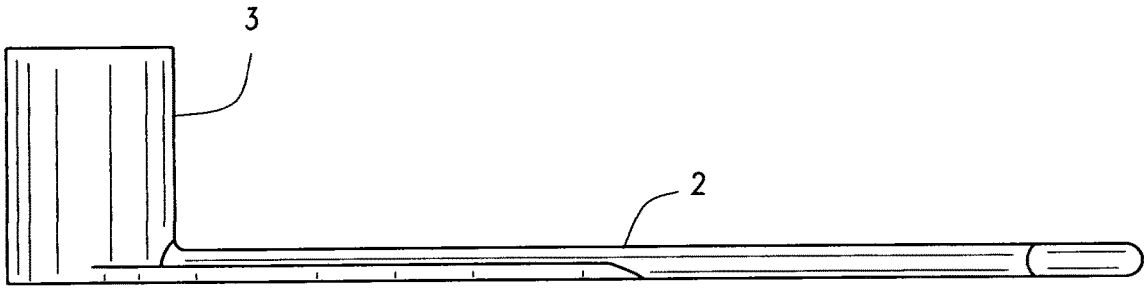
FIG. 4 is a left side view.
Figure 5:
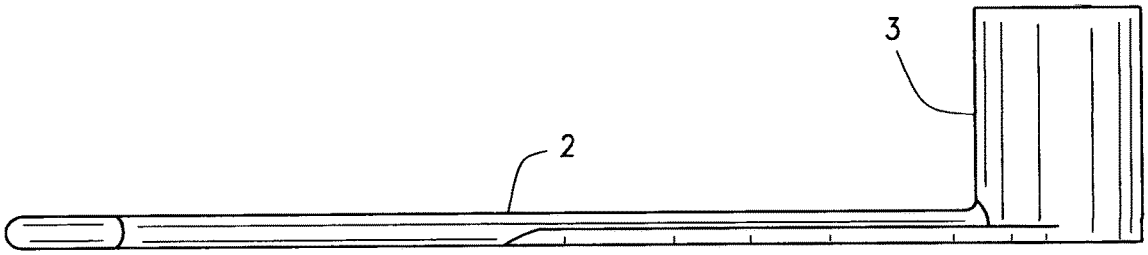
FIG. 5 is a right side view.
Figure 6:
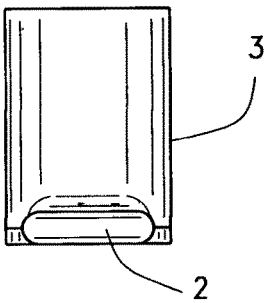
FIG. 6 is a back end view.
Figure 7:
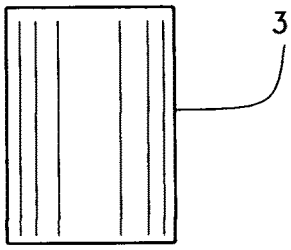
FIG. 7 is a front end view.

One can see the relative dimensions between the handle 2 of the wrench, and the height of its socket 3, as noted in FIGS. 4 and 5, and similar views can be taken from the FIGS. 6 and 7 embodiments, showing the front and back views of the wrench.

It has been determined that with the length of the handle, in addition to its socket, and in particular the distance between the interior sides of the hexagonal insert 10, provides a leverage of approximately 12:1, in the transition of the force from the handle transmitted to the socket, during its usage. This provides a substantial enhancement of the force, and provides the need for reinforcing the interior of the socket, through the use of the metal insert, so as to prevent a stripping of the socket of the wrench, as it exerts such excessive force upon the propeller nut, during its removal, or installation.

Variations or modifications of the subject matter of this invention may occur to those skilled in the art upon review of the disclosure as provided herein. Such variations, if within the spirit of this invention, are intended to be encompassed within the scope of any claims to patent protection issuing herein. The review of the invention and the summary and its description of the preferred embodiment, and as shown in the drawings, are set forth for illustrative purposes only.

What is claimed is:

1. A boat motor propeller wrench, comprising:

a polymer handle comprising a first end and a second end opposite the first end, the second end including a tethering aperture;

a socket formed as one piece with the polymer handle and extending from the first end of the polymer handle substantially perpendicular thereto, the socket defining an aperture comprising an upper segment and a lower segment, wherein the upper segment is of a first diameter of a first configuration and the lower segment is of a second diameter of a second configuration; and a metallic insert with a top end and a bottom end disposed within the aperture of the socket wherein the lower segment of the second configuration fixedly encloses the bottom end of the metallic insert.

2. The boat motor propeller wrench of claim 1, wherein the metallic insert is disposed within the upper segment of the aperture, the metallic insert being of the first diameter.

3. The boat motor propeller wrench of claim 1, wherein the first diameter is greater than the second diameter.

4. The boat motor propeller wrench of claim 1, wherein the first configuration is a hexagonal configuration.

5. The boat motor propeller wrench of claim 1, wherein the second configuration is a square configuration.

6. The boat motor propeller wrench of claim 1, wherein a ratio of a length dimension of the polymer handle to the first diameter is 12:1.

7. The boat motor propeller wrench of claim 1, wherein the metallic insert is molded into the socket.

8. The boat motor propeller wrench of claim 1, wherein the metallic insert is coupled with the socket.

9. The boat motor propeller wrench of claim 1, wherein the polymer handle comprises integrated flanges on opposite sides of the polymer handle to reinforce the polymer handle.

10. The boat motor propeller wrench of claim 1, further comprising a gap between the aperture and the metallic insert.

11. The boat motor propeller wrench of claim 10, further comprising an adhesive layer filling the gap between the aperture and the metallic insert.

12. The boat motor propeller wrench of claim 1, wherein the polymer handle comprises a reinforcing metallic bar.

* * * * *